United States Patent [19]

Kuroda et al.

[11] 4,191,508

[45] Mar. 4, 1980

[54] TURBINE ROTOR CONSTRUCTION

[75] Inventors: Michio Kuroda; Yoshiaki Yamazaki; Kiyoshi Namura; Fumio Kato; Yasuaki Akatsu; Daizo Morimoto; Satoshi Ninomiya, all of Hitachi, Japan

[73] Assignees: Hitachi, Ltd., Japan; Hitachi Kizai Kogyo Co. Ltd., Japan

[21] Appl. No.: 873,773

[22] Filed: Jan. 31, 1978

[30] Foreign Application Priority Data

Feb. 2, 1977 [JP] Japan ..... 52-978277

[51] Int. Cl.[2] ..... F01D 5/10; F01D 5/24

[52] U.S. Cl. ..... 416/196 R; 416/190; 416/500

[58] Field of Search ..... 416/193 A, 190, 191, 416/196 R, 221, 500

[56] References Cited

U.S. PATENT DOCUMENTS

| | | | |
|---|---|---|---|
| 924,546 | 6/1909 | Emmet | 416/191 |
| 937,006 | 10/1909 | McKee | 416/196 |
| 1,068,512 | 7/1913 | Ljungström | 416/196 |
| 1,253,834 | 1/1918 | Junggren | 416/196 |
| 1,888,795 | 11/1932 | Faber | 416/196 |
| 3,045,969 | 7/1962 | Meienberg | 416/190 X |
| 3,180,616 | 4/1965 | Miller | 416/196 |
| 3,527,546 | 9/1970 | Zeman | 416/196 R |

FOREIGN PATENT DOCUMENTS

| | | | |
|---|---|---|---|
| 306083 | 6/1918 | Fed. Rep. of Germany | 416/191 |
| 728116 | 11/1942 | Fed. Rep. of Germany | 416/196 R |
| 255540 | 7/1926 | United Kingdom | 416/191 |

*Primary Examiner*—Everette A. Powell, Jr.
*Attorney, Agent, or Firm*—Craig and Antonelli

[57] ABSTRACT

A turbomachine rotor arrangement is provided having a rotor wheel and blades thereon with a tie pin for interconnecting adjacent blades. A plurality of blades respectively define tie holes wherein the tie holes of adjacent blades are disposed with the radial heights of said holes being different and with the tie pin disposed in the tie holes so as to be acted upon by respective different amplitudes of vibration than said adjacent blades during rotation.

6 Claims, 12 Drawing Figures

TURBINE ROTOR CONSTRUCTION

BACKGROUND AND SUMMARY OF THE INVENTION

This invention relates to a turbomachine rotor arrangement and more particularly to a lashing or tying construction for turbine rotor blades.

As rotation machines such as a pressure compressor have been required to be gradually driven at higher speeds, steam turbines for driving them have also been required to be operated at higher rotational speeds. Turbine blades of such high speed turbines are exposed in a state that extremely large centrifugal force occurs thereon, so that high stress is generated on stress concentration portions such as at blade fixing portions on a rotor wheel.

In order to avoid stress concentration on the blade fixing portions at the high speed, recent high speed steam turbines have been made with the periphery of the circumference of a cylindrical member cut or machined to be formed with blade portions integral (one-piece homogeneous material) with a rotor wheel portion. Turbines with such construction are advantageous in strength, because large stress does not occur on the blade fixing portions.

The latest turbines, however, are needed to drive rotation machines at a further higher speed and under a higher load.

Since the blades integrally formed with the rotor wheel portion are not favorable arranged for mechanical vibration damping effects, the logarithm damping rate becomes equal to that of the rotor member itself.

Accordingly, said blades exhibit a tendency for vibration stress to become extremely large in comparison with usual separate blades assembled on a rotor wheel, because the vibration damping effect is drastically reduced.

Under this circumstance it is required to effectively damp the vibration at the high speed for blades, especially blades integrally formed with a rotor wheel portion.

Prior arrangements have been provided for lashing adjacent turbine blades together to reduce or damp vibration effects during operation. However, these prior arrangements, as exemplified by U.S. Pat. Nos. 3,527,546 to Zeman, and 3,795,462 to Trumpler, Jr., as well as Canadian Pat. No. 752,203 to Jensen, positioned the tie connections at a constant radial height on adjacent blades. The present invention is directed at improving such vibration damping arrangements.

An object of the invention is to provide a turbomachine rotor arrangement which can effectively restrain the vibration of the blades.

Another object of the invention is to provide a turbomachine rotor arrangement which can effectively restrain, at the high speeds, the vibration of blades which are integrally formed with a rotor wheel from one rotor member.

Another object of the invention is to provide a turbomachine rotor arrangement which can damp circumferential direction vibration, blade arrangement direction vibration, and torsional vibration.

Another object of the invention is to simplify the rotor and blade arrangement so as to make the manufacture thereof more economical.

An important feature of the invention is the provision of a turbomachine rotor arrangement having a rotor wheel and blades thereon with tie means for interconnecting adjacent blades, comprising a plurality of blades respectively defining tie holes wherein adjacent blades define tie holes with the radial distances between each center of said holes and the circumferential surface of the rotor wheel being different, and with tie means for interconnecting said plurality of blades, said tie means being disposed in said tie holes so as to be acted upon by different amplitudes of vibration thereon at respective adjacent blades during rotation.

This arrangement of the tie holes at different radial heights on the respective adjacent blades assures that the tie means provide a damping effect on each of the: (i) circumferential direction blade vibration, (ii) the blade arrangement direction blade vibration, and (iii) the torsional blade vibration.

In certain particularly preferred embodiments, the rotor and blades are formed integrally with one another from a unitary piece of material.

In some preferred embodiments, the tie means are formed as rigid straight tie pins extending through tie holes in three or more adjacent rotor blades with a small clearance between the tie holes and the tie pins, whereby centrifugal forces during rotation frictionally lock the tie pins to the blades.

In other preferred embodiments, the tie means are formed as rigid straight tie pins extending through tie holes in three or more adjacent blades, with the blades and tie pins being welded together at the tie pins.

These and further objects, features and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
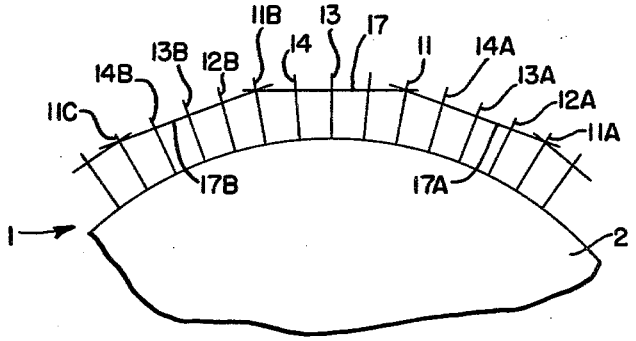
FIG. 1 is a schematic partial axial front view of a turbine rotor arrangement embodying the invention.
Figure 2:
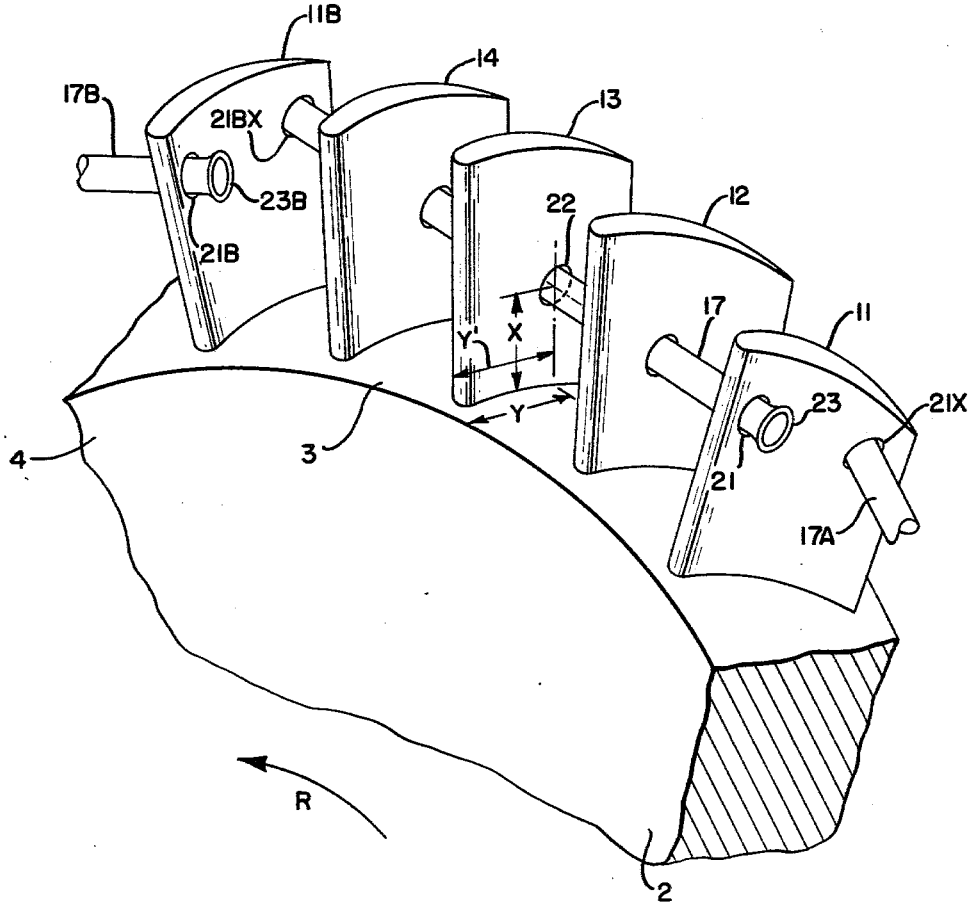
FIG. 2 is an enlarged perspective view of a portion of FIG. 1, depicting a first preferred embodiment of the invention.
Figure 3:
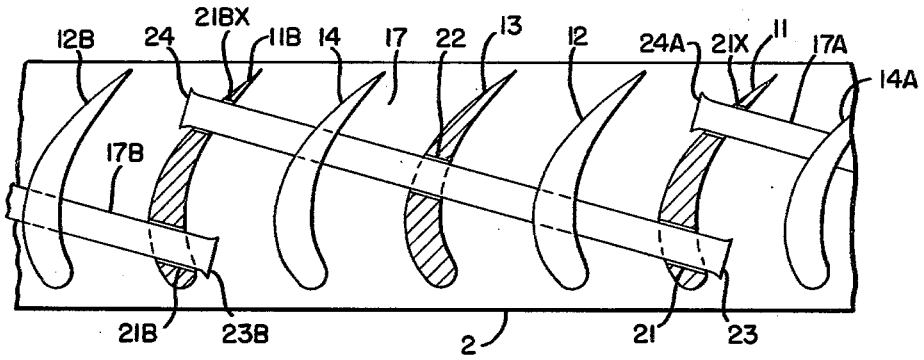
FIG. 3 is a radial projected schematic view showing the turbine blade arrangement of FIG. 2.

Referring to FIGS. 1, 2 and 3, one embodiment of the invention is schematically illustrated, including a turbine rotor 1 with a rotor wheel 2, turbine blades 11, 12, 13, 14 and a straight tie pin 17. In this turbine rotor arrangement, the blades 11, 12, 13, 14 are integrally formed with the rotor wheel 2 from a one piece cylindrical member. A plurality of groups of blades are made by blades 11, 12, 13, 14 and 11B, 11A, 12A, 13A, 14A and 11; 11B, 12B, 13B, 14B and 11C. Each group of blades is connected by a tie pin 17 (17A, 17B) which is installed on every group to form a set of blades.

FIG. 2 illustrates positions of tie holes defined on the blades 11, 12, 13, 14, 11B, the relationship between the adjacent tie holes and an arrangement of the tie pin 17. The distance or height between the center of any blade tie hole and the circumferential surface 3 of the rotor wheel 2 is shown by X and the distance between the center of the blade tie hole and an upstream side surface 4 of the rotor wheel 2 is shown by Y. The Y may be substituted by Y' showing the distance between the center of the blade tie hole and the top edge of the blade on the circumferential surface 3.

In this embodiment the value of X is largest on the side blades 11, 11B and becomes gradually smaller in the direction of the center blade 13 and is smallest on this middle blade 13. The value of Y or Y' increases with the shift from the blade 11 toward the blade 11B. This means the value of Y or Y' increases with the rotation direction R.

FIG. 3 shows in detail that the tie pin 17 is set up through the tie holes of the blades 11, 12, 13, 14 and 11B. Both side blades 11 and 11B are also elements of adjacent sets and assembled by the tie pins 17, 17A and 17B, respectively.

Each blade defines one tie hole (depicted at 21 in blade 11, 22 in blade 13, 21B in blade 11B) for accommodating the tie pin 17. The side blades 11B and 11 include additional tie holes 21B, 21X, for accommodating respective tie pins 17B and 17A. The hole 21 is located on a leading portion of the blade 11 and the hole 21X is located on a trailing portion of the blade 11. The tie pin 17 is loosely disposed in the tie holes of the middle blades 12, 13, 14 and the tie holes 21, 21BX of the side blades 11, 11B.

Stoppers 23, 24 are formed on the end portions of the tie pin 17 extending through the holes 21, 21BX of the blades 11, 11B in order to prevent release of the tie pin 17 from the tie holes.

Another tie pin 17A connects another set of the blades 11A, 12A, 13A, 14A and 11 and passes through the holes 21X of the blade 11. A stopper 24A is similarly formed on the end portion of the tie pin 17A. Another set of the blades 11B, 12B, 13B, 14B and 11C is arranged similarly to the other described sets. Thus each set of blades is connected by each tie pin and adjacent sets are also connected by each tie pin.

According to the above construction, since there exist smoothly movable connecting surfaces on the tie holes and the tie pin 17, the tie pin 17 is pressed on the surfaces of the tie holes by the centrifugal force due to rotation and the adjacent blades are connected. When relative displacement occurs between the blades and the tie pin 17 on the contacting surfaces, frictional force is generated in accordance with a turbine speed and act so as to absorb or damp the vibration.

As the values of X and Y or Y' are different at every blade as shown in FIG. 2, the amplitudes of the vibration appear different at every blade (at the tie holes contacting the tie pins), even in instances when each blade vibrates in a different mode, and even though the same vibration frequency would occur and the vibration mode is identical for every blade of each set. The difference of the amplitude corresponds to the positions of the tie holes, namely the distances X and Y or Y'.

In comparison with a prior rotor arrangement having a tie pin connecting a plurality of blades with the tie pin disposed in parallel to the circumferential surface of the rotor wheel, (this means the values of X and Y or Y' are equal for each blade) this embodiment of FIG. 2 can obtain larger vibration damping effect, because when the vibration occurs, it is more reliably assured that the frictional force acts on the contacting surfaces for all experienced vibrations.

In comparison with another prior rotor arrangement with one tie pin disposed at adjacent pairs of blades and with the values of X equal but the value of Y or Y' different at different blades, this embodiment of FIG. 2 can obtain a larger vibration damping effect, because of the different values of both X and Y at respective adjacent blades.

Furthermore, the above-mentioned vibration damping effect is promoted by the connection between the adjacent sets of blades with respect to each other. Through the connection of the sets, the vibration generated on one blade is transmitted to a lot of blades and absorbed. Especially when a turbine is operated in a partial steam inflow, large steam force acts on a partial area of blades in unbalance. According to the construction of the embodiment of FIG. 2, the unbalance force is immediately diverted to a neighboring blades and the stress due to the vibration is relieved.

In the embodiment of FIG. 2 it will be noted that the value of X is smallest on the middle blade 13 and largest on the side blades 11, 11B. The centrifugal force on the tie pin 17 is larger on the side blades 11, 11B than the force on the middle blade 13. The connection of adjacent sets of blades is made on the blades 11, 11B acted on by the largest centrifugal force, so that the transmission of the force is optimally made to divert the vibration to all blades.

A slightly curved tie pin may be used according to certain contemplated embodiments. However, the straight tie pin of the FIG. 2 embodiment results in advantages with respect to ease of manufacture.

The tie holes may be configured in such a way that the value of Y or Y' gradually becomes smaller with rotor rotation direction. This altered construction also has similar function as does the embodiment shown in FIG. 2.

Figure 4:
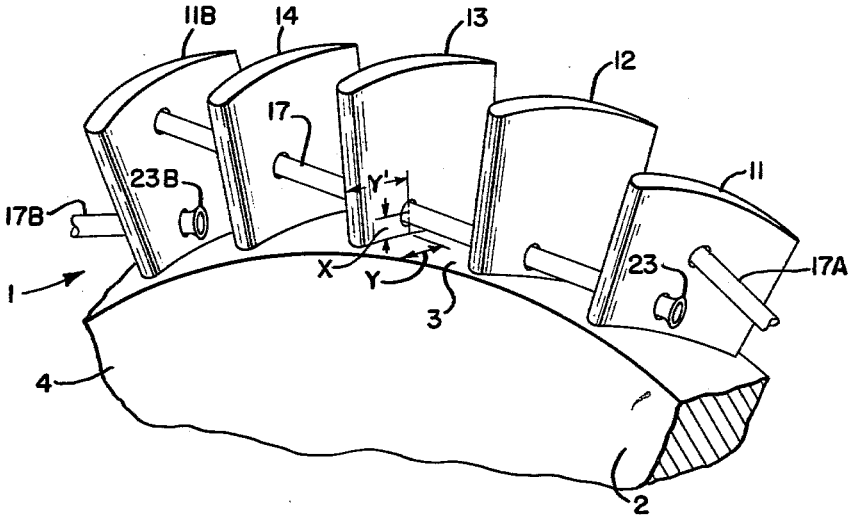
FIG. 4 is a perspective view similar to FIG. 2, showing a second preferred embodiment of the invention.
Figure 5:
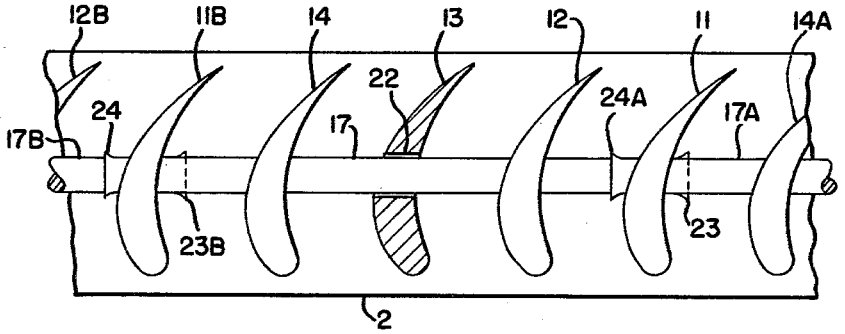
FIG. 5 is a radial projected schematic view showing the turbine blade arrangement of FIG. 4, partly in section.

Referring to FIGS. 4 and 5 illustrating another embodiment, a tie pin 17 is disposed along the blade arrangement direction. The value of X may also be made smaller in the rotor rotation direction in accordance with other contemplated embodiments. This embodiment also has similar functions as the embodiment shown in FIG. 2 has with respect to damping vibrations occurring in the blades.

Figure 6:
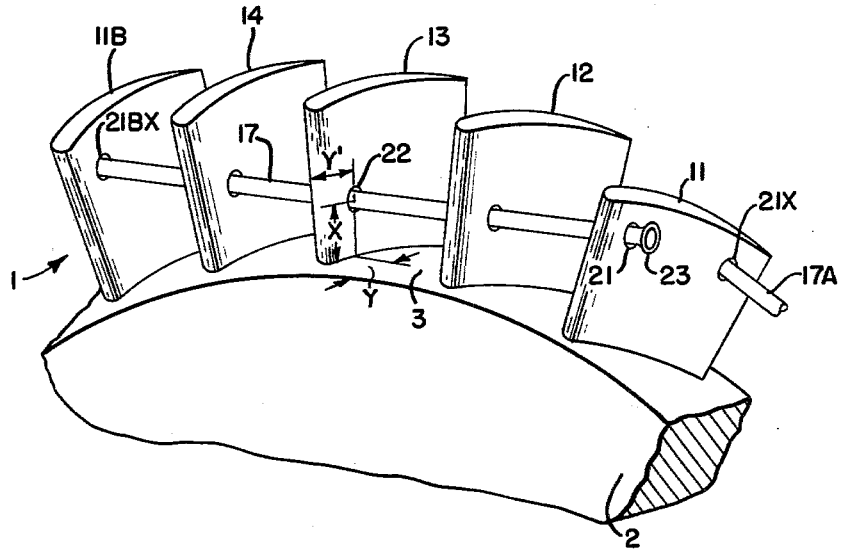
FIG. 6 is a perspective view of a partial turbine rotor arrangement according to a third preferred embodiment of the invention.

Referring to FIG. 6 illustrating another embodiment, a row of tie holes and a tie pin 17 are disposed along the blade arrangement direction and the value of X is different on the adjacent blades, but the value of X is equal on the blades 12, 14; 11, 11B. In this embodiment, since the height of the tie holes from the circumferential surface 3 of the rotor wheel 2 is different on the adjacent blades, when the blades vibrate during rotation, the relative displacement occurs on the contacting surfaces of the tie pin 17 and the tie holes to effect the vibration damping due to the frictional force.

Figure 7:
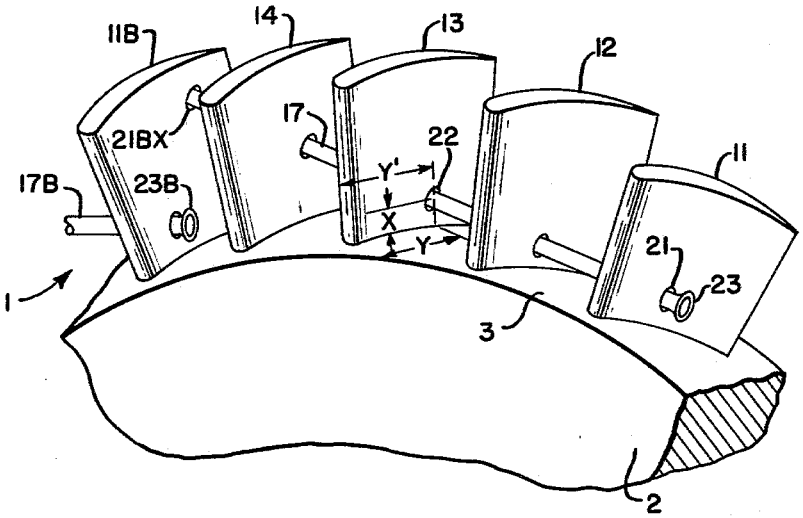
FIG. 7 is a perspective view of a partial turbine rotor arrangement according to a fourth preferred embodiment of the invention.

Referring to FIG. 7 illustrating yet another embodiment, a row of tie holes and a tie pin 17 is obliquely disposed to the blade arrangement direction and the height X of the holes are gradually increased toward the rotor rotation direction. When the blades vibrate during rotation, the relative displacement occurs on the contacting surfaces of the tie pin 17 and the holes to effect the vibration damping due to the frictional force.

In the above embodiments five blades are connected by one tie pin, but the invention is not limited to these embodiments. This invention may be applied to two blade connection arrangements, but a desirable result is obtained in a rotor arrangement with more than two blades according to especially preferred embodiments of the invention. Its function will be subsequently explained.

Assume that only two blades are connected by one tie pin, a set of blades will then consist of only side blades. When torsional vibration occurs (angular vibration about respective radial axes through the blades) the torsional moment is transmitted through two adjacent tie pins. The relative displacement is mainly restrained by the torsional moment, but not the frictional force. On the contrary, when three or more than three blades are connected, there exists one middle blade at least which is relatively free from the torsional moment. With increasing of the number of middle blades, the vibration damping rate increases so that the vibration damping effect becomes larger.

Figure 8:
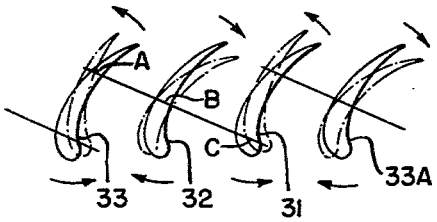
FIG. 8 is a schematic view showing three turbine blades connected by a tie pin.

Referring to FIG. 8 illustrating a three blade connection arrangement, connection points are shown by A, B and C. When the torsional vibration occurs on the blades 31, 32, 33, the amplitude of vibration on the point B is smaller than the amplitudes of vibration on the point A or C. Thus, the distance between the points A and B, and B and C enlarge and the relative displacement is produced, effecting the vibration damping due to the frictional force.

Figure 9:
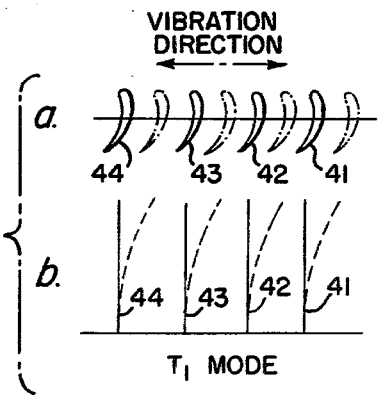
FIGS. 9, 10 and 11 are schematic views illustrating three kinds of blade vibration.
Figure 10:
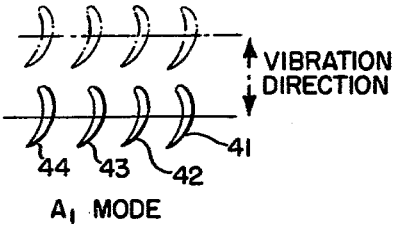
Figure 11:
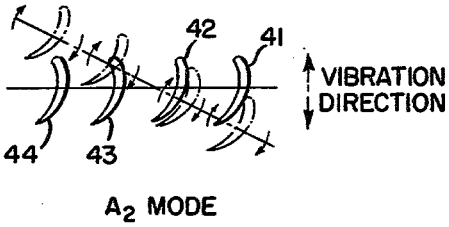

Referring to FIGS. 9, 10 and 11 illustrating a set of blades, there generally appear vibration modes (i) $T_1$ which is a first vibration mode in the rotor circumferential direction, (ii) $A_1$ which is a first vibration mode in the longitudinal (rotor axial direction) direction of a set of blades, and (iii) $A_2$ which is second vibration mode in the longitudinal direction coupled with torsional movement of a set of blades. The $T_1$ mode is one in which each of the blades vibrates in the same phase and in the rotor circumferential direction as shown in FIG. 9. The $A_1$ mode is one in which each of the blades vibrates in the same phase and in the rotor longitudinal direction as shown in FIG. 10. The $A_2$ mode is one in which side blades 41, 44 vibrate in an opposite phase with respect to each other and in the longitudinal direction, and the amplitudes of vibration of middle blades 42, 43 appear smaller than the amplitudes of vibration on the side blades as shown in FIG. 11. The $A_2$ mode is formed of a longitudinal vibration displacement and a torsional displacement about the torsion center of the blade.

In the above described embodiments, adjacent blades are connected on different radial heights by the tie pins. This makes the relative displacement occur on the contacting surfaces to damp or absorb the vibration of the $T_1$ and $A_1$ modes and the longitudinal vibration in the $A_2$ mode. In the embodiments shown in FIGS. 2 and 7, since the tie pin is obliquely disposed to the blade arrangement, this blade arrangement further enhances the effective absorption of damping of the torsional vibration in the $A_2$ mode.

Figure 12:
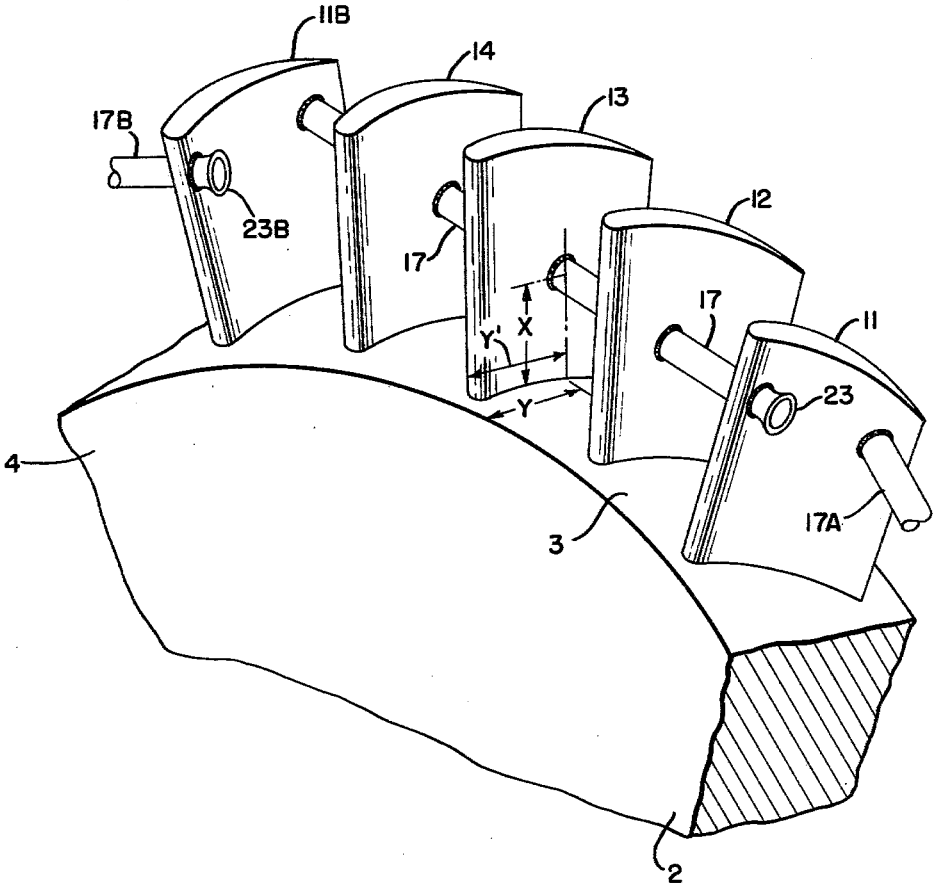
FIG. 12 is a perspective view of a partial turbine rotor arrangement according to a fifth embodiment of the invention.

Referring to FIG. 12 illustrating another embodiment, a tie pin 17 is solidly fixed on all blades by welding in the area of the tie holes. Otherwise the arrangement is identical to the arrangement of FIG. 2. Because of the lack of frictional force, the vibration damping effect is inferior to the arrangement of FIG. 2, but this arrangement may be employed for a turbomachine which is not required to operate at extremely high speed.

As explained above, according to the invention the failure of the rotor can be avoided during the high speed rotation by the improved vibration damping effects.

In prior blade arrangements with a small blade pitch, it has been difficult to arrange the tie holes in parallel to the circumferential surface of the rotor wheel on the blades integrally formed with a rotor wheel. On the contrary, in the invention since straight holes may be defined, it becomes easy to make the holes on the blades even if the blades are integrally formed with a rotor wheel and blade pitch is very narrow.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A turbomachine rotor arrangement having a rotor wheel and blades thereon with tie means for interconnecting adjacent blades, the arrangement comprising:

at least three adjacent blades respectively defining tie holes, wherein adjacent blades define tie holes in which the distances between centers of respective ones of said holes and the circumferential surface of the rotor wheel are different, and wherein said tie holes are disposed such that the distances between respective centers of the holes and the leading edge of the associated respective blades are also different, and tie means for interconnecting said blades, disposed in said tie holes with frictional engagement during rotation of said rotor so as to be acted upon by different amplitudes of vibration at respective ones of said adjacent blades during rotation.

2. A turbomachine rotor arrangement according to claim 1, wherein said tie means includes a substantially straight tie pin.

3. A turbomachine rotor arrangement according to claim 2, wherein said tie pin is loosely disposed in said tie holes when said rotor wheel and blades are at rest.

4. A turbomachine rotor arrangement according to claim 1, wherein sets of a plurality of the blades are interconnected by the tie means to adjacent sets respectively comprising a plurality of blades.

5. A turbomachine rotor arrangement according to claim 1, wherein the rotor and the blades have an integral one-piece structure formed from a single solid homogeneous piece of material.

6. A turbomachine rotor arrangement according to claim 5, wherein the blades are machined at the periphery of a solid cylindrical block which also forms the rotor wheel.

* * * * *